US009956738B1

(12) United States Patent
Olson et al.

(10) Patent No.: US 9,956,738 B1
(45) Date of Patent: May 1, 2018

(54) AUTOMATED BAG FORMER

(71) Applicants: Paul A. Olson, Mora, MN (US); Donald W. Olson, Mora, MN (US)

(72) Inventors: Paul A. Olson, Mora, MN (US); Donald W. Olson, Mora, MN (US)

( * ) Notice: Subject to any disclaimer, the term of this patent is extended or adjusted under 35 U.S.C. 154(b) by 823 days.

(21) Appl. No.: 14/203,509

(22) Filed: Mar. 10, 2014

Related U.S. Application Data

(60) Provisional application No. 61/775,432, filed on Mar. 8, 2013.

(51) Int. Cl.
*B31B 1/60* (2006.01)
*B31B 19/10* (2006.01)

(52) U.S. Cl.
CPC ..... *B31B 19/10* (2013.01)

(58) Field of Classification Search
CPC ..... B31B 19/10; B31B 37/00; B31B 2237/05; B31B 19/90; B31B 41/00; B31B 2237/50
USPC ..... 493/210, 13, 14, 10, 197, 203, 208
See application file for complete search history.

(56) References Cited

U.S. PATENT DOCUMENTS 3,933,563 A * 1/1976 Carlisle ..... B29C 65/18 156/251
3,943,683 A * 3/1976 Kovacs ..... B65B 57/00 53/51
4,114,520 A * 9/1978 Achelpohl ..... B31B 23/00 156/515
4,380,446 A * 4/1983 Dickson ..... B29C 65/18 493/11
4,642,084 A 2/1987 Gietman, Jr.
4,743,337 A 5/1988 Moran et al.
4,758,293 A * 7/1988 Samida ..... B29C 65/08 156/308.4
4,934,993 A 6/1990 Gietman, Jr.
5,518,559 A * 5/1996 Saindon ..... B26D 5/20 156/353
5,814,382 A 9/1998 Yannuzzi, Jr.
6,003,582 A 12/1999 Blohowiak et al.
6,319,182 B1 * 11/2001 Schneider ..... B31B 19/74 493/10
6,368,437 B1 * 4/2002 Ziegelhoffer ..... B29C 65/08 156/308.4
6,820,399 B2 * 11/2004 Send ..... B65B 41/18 493/10
6,974,406 B2 12/2005 Antonacci
7,811,219 B2 * 10/2010 Sauder ..... B26D 5/32 493/11
8,012,076 B2 9/2011 Selle et al.

FOREIGN PATENT DOCUMENTS

WO 2007/106916 A1 9/2007
WO 2011050354 4/2011

* cited by examiner

*Primary Examiner* — Sameh Tawfik
(74) *Attorney, Agent, or Firm* — Underwood & Associates, LLC

(57) ABSTRACT

Automated bag forming systems and methods for their use are disclosed. The automated bag forming systems described herein can be configured to receive a web of bag material and produce individual bags through a sealing and cutting process possessing a high degree of speed, precision, and reproducibility.

1 Claim, 18 Drawing Sheets

AUTOMATED BAG FORMER

CROSS REFERENCE TO RELATED APPLICATIONS

This application claims priority to and the benefit of U.S. Provisional Patent Application No. 61/775,432 filed on Mar. 8, 2013.

TECHNICAL FIELD

This disclosure relates to systems and methods for automating a bag forming process. In particular, this disclosure relates to an automated bag former capable of sealing and cutting individual bags from a web and can be used in a variety of industrial bag-forming processes.

BACKGROUND

Various types of bags are available for packaging consumer products. As consumers are generally aware, bags may be formed of plastic, paper, or any other material suitable to contain the product therein. Each year, millions of bags are formed around the world to contain various foodstuffs. In one example, bags can be configured to allow a food to be cooked within, such as popcorn bags that hold corn kernels. Certain vegetables can similarly be steam-cooked within substantially sealed bags that are configured for microwave use.

Bags can be formed from a substantially continuous length of precursor material commonly referred to as a "web." Webs are generally available as large rolls and may have indicia printed thereon, such as product information, marks designed to be read by optical registration systems during bag-making processes, or both.

SUMMARY

Automated bag forming systems and methods for their use are disclosed. The automated bag forming systems described herein can be configured to receive a web of bag material and produce individual bags through a sealing and cutting process possessing a high degree of speed, precision, and reproducibility.

In one exemplary aspect, a system for producing bags from a web of bag material includes a rotatable drum assembly having a plurality of sealing assemblies coupled thereto that are configured to receive and seal a portion of the web of bag material. The sealing assemblies are circumferentially disposed about the periphery of the drum and are capable of shifting along an axis that is substantially perpendicular to the rotational axis of the drum to increase or decrease a working diameter of the drum assembly.

The system further includes a stationary cylinder cam axially aligned with the rotatable drum. The cylinder cam includes a circumferential groove configured to receive a cam follower extending from each sealing assembly. The cam follower is attached to a reversibly shiftable drive bar that is capable of shifting from a first position to a second position to correspondingly reversibly shift a seal bar of the sealing assembly from an open configuration to a closed, sealing configuration. In this embodiment, the seal bar can be heated to a temperature necessary to seal the web in a specified location. The system further includes a cutting assembly configured to cut the web substantially near the location of the newly-formed seal to produce individual bags from the web of bag material in an automated bag-forming process.

During operation of the automated bag former, the working diameter of the drum assembly can be increased or decreased, which causes a corresponding increase or decrease in the distance between adjacent sealing assemblies. Throughout this disclosure, such functionality is referred to as "variable-pitch." By this virtue, and in cooperation with a computer-based, PID-based feedback loop system described in greater detail herein, adjustments can be made to the working diameter of the drum so that seals can be made in precise locations on the web.

In one exemplary aspect, an automated bag forming system is disclosed. The system includes a stationary cylinder cam having a continuous, substantially sinusoidal groove disposed about its periphery and a rotatable drum coaxially aligned with the cylinder cam. The cylinder cam includes a plurality of circumferentially-disposed sealing assemblies. Each sealing assembly includes a sealing surface for receiving a portion of a web of bag material, a reversibly-shiftable seal bar configured to shift between an open configuration and a closed configuration wherein the seal bar confronts the sealing surface to form a seal in the web, and a reversibly-shiftable drive bar. The drive bar includes a cam follower configured to ride in the sinusoidal groove as the rotatable drum rotates to cause the drive bar to shift, wherein shifting of the drive bar causes synchronous shifting of the seal bar between the open and the closed configurations. Each sealing assembly is coupled to a variable-pitch control assembly via a radially-translatable frame member that is configured to reversibly shift each of the plurality of sealing assemblies along a respective correction pathway that is perpendicular to the rotational axis of the rotatable drum. The system further includes a control system configured to detect a registration mark on the web at a detection location on the system, substantially synchronously measure a rotational angle value of the rotatable drum, and determine an angle difference value representing the difference between the measured rotational angle value of the rotational drum and a stored optimal drum angle value that is correlated with the detection location. The control system is further configured to send an output control signal to the variable-pitch control assembly if the angle difference value is outside of a predetermined tolerance range.

In one embodiment, the variable-pitch control assembly includes a rotatable cam and a motor in signal communication with the control system configured to rotate the rotatable cam in clockwise or counterclockwise directions in response to the output control signal. In a related embodiment, rotation of the rotatable cam is independent of rotation of the rotatable drum. In yet another related embodiment, the rotatable cam includes a plurality of spiraled grooves, and each of the radially-translatable frame members includes a cam follower configured to ride within the spiraled grooves to cause the sealing assemblies to translate along the correction pathway.

In one embodiment, the automated bag forming system further includes an optical detection system in signal communication with the control system for optically detecting the registration mark.

In one embodiment, the distance between a first sealing assembly and a second, adjacent sealing assembly is adjustable. In a related embodiment, the distance is adjustable by rotating the spiral cam in a selected direction to cause the plurality of sealing assemblies to shift outwardly or inwardly along the correction pathway.

In one embodiment, the output control signal causes the variable-pitch control assembly to shift each of the sealing assemblies along the correction pathway so as to reduce the angle difference value on a subsequent angle difference value determination.

In one embodiment, the sealing assemblies are configured such that, during operation, each sealing assembly sequentially receives a portion of the web on the sealing surface as the rotatable drum rotates, the seal bar translates horizontally to a position over the web, then translates vertically to confront the web against the sealing surface in the closed configuration to create a seal in the web. In a related embodiment, after the seal has been made, the seal bar shifts from the closed configuration to the open configuration to allow the web to disengage from the sealing surface.

In one embodiment, the automated bag forming system further includes a plurality of the rotatable drums configured to receive the web serially. In a related embodiment, the sealing assemblies of a first of the rotatable drums is configured to create a first series of seals in the web, and the sealing assemblies of a second of the rotatable drums is configured to create seals interposed between each seal of the first series of seals.

In one exemplary aspect, an automated bag forming system is disclosed. The automated bag forming system includes a stationary cylinder cam having a continuous, substantially sinusoidal groove disposed about its periphery, and a rotatable drum coaxially aligned with the cylinder cam. In this embodiment, the rotatable drum includes a plurality of circumferentially-disposed sealing assemblies. Each sealing assembly includes a sealing surface for receiving a portion of a web of bag material, a reversibly-shiftable seal bar configured to shift between an open configuration and a closed configuration wherein the seal bar confronts the sealing surface to form a seal in the web, and a reversibly-shiftable drive bar that includes a cam follower configured to ride in the sinusoidal groove as the rotatable drum rotates to cause the drive bar to shift, wherein shifting of the drive bar causes synchronous shifting of the seal bar between the open and the closed configurations. In this embodiment, transitioning from the open configuration to the closed configuration includes a horizontal seal bar shifting motion followed by a vertical seal bar shifting motion.

In one embodiment, the seal bar is coupled to a translatable carriage member which in turn is coupled to the reversibly-shiftable drive bar; the sealing surface is coupled to a fixed support member which in turn is coupled to an outer surface of the rotatable drum; furthermore the translatable carriage member is configured to translate along an L-shaped slot in the stationary support member to allow shifting in both of the vertical and horizontal directions. In a related embodiment, at least one of the sealing surface or the seal bar is heated to allow sealing of the web.

In one exemplary aspect, an automated bag forming system is described. The system includes a stationary cylinder cam having a continuous, substantially sinusoidal groove disposed about its periphery, and a rotatable drum coaxially aligned with the cylinder cam. The rotatable drum includes a plurality of circumferentially-disposed sealing assemblies, wherein each sealing assembly is coupled to a variable-pitch control assembly via a radially-translatable frame member that is configured to reversibly shift the plurality of sealing assemblies along a correction pathway that is perpendicular to the rotational axis of the rotatable drum.

In one embodiment, the variable pitch control assembly includes a rotatable, disk-like cam having a plurality of spiral slots therein, wherein each slot is configured to receive a cam follower disposed on an end of the radially-translatable frame member. In a related embodiment, rotation of the variable-pitch control assembly is independent of rotation of the rotatable drum. In yet another related embodiment, the system further includes a computer-based control system capable of determining a difference value representing a difference between a measured angle of the rotational drum and a pre-determined optimal rotational angle of the rotational drum upon receiving a registration mark detection signal, and sending a control signal to a motor assembly to cause rotation of the disk-like cam in a direction that reduces the difference value in a subsequent measurement.

In one embodiment, an effective working diameter of the rotatable drum is adjustable by translating the sealing assemblies inwardly or outwardly along the correction pathway.

The systems and methods disclosed herein provide certain distinct advantages; among those include the ability to produce bags from a web of bag material in an automated process, at a high rate of speed while maintaining a high degree of accuracy in the placement of bag seals. The dimensions of the resulting bag products e.g., after they are cut into individual bags, can thus be highly reproducible.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate similar elements, and in which.

DETAILED DESCRIPTION OF ILLUSTRATIVE EMBODIMENTS

In the description that follows, a 'web' refers to a continuous sheet of material that is configured to be sealed and cut in order to prepare individual bags. One non-limiting example of a web for producing popcorn bags is described in U.S. Pat. No. 6,137,098 to Moseley et al., which is incorporated herein by reference in its entirety. It will be understood, however, that the systems and methods described herein are equally applicable to other web types and for forming other bag types, without limitation.

In one exemplary embodiment, an automated bag former includes one or more roller assemblies for receiving a web of bag material, where the one or more assemblies are configured to prepare the web to be fed onto a rotatable drum assembly. The rotatable drum assembly includes a plurality of circumferentially-disposed sealing assemblies are configured to place seals in the web at selected locations as described in greater detail herein. The bag former further includes a web-cutting assembly configured to receive the web after it has traversed the rotatable drum assembly and cut the web to form individual bags.

In this embodiment, each sealing assembly includes a sealing surface where the web is clamped between the sealing surface and a seal bar to form a seal in the web. In this embodiment, the working diameter of the plurality of circumferentially-disposed sealing surfaces can be increased or decreased. Doing so causes a corresponding increase or decrease, respectively, in the distance between sealing assemblies, and thus can be used to fine-tune the position of web seals. In this embodiment, a computer-based proportional-integral-derivative (PID) process cooperates with an optical detection system to adjust the distance between sealing assemblies, in other words, to control variable pitch of the sealing assemblies. In an automated process where thousands of individual bags may be produced, the bag former can reduce the number of faulty bags resulting from misplaced seals or cuts (or both) substantially. Furthermore, such a system allows for quick and easy adjustment to produce different bags.

Figure 1:
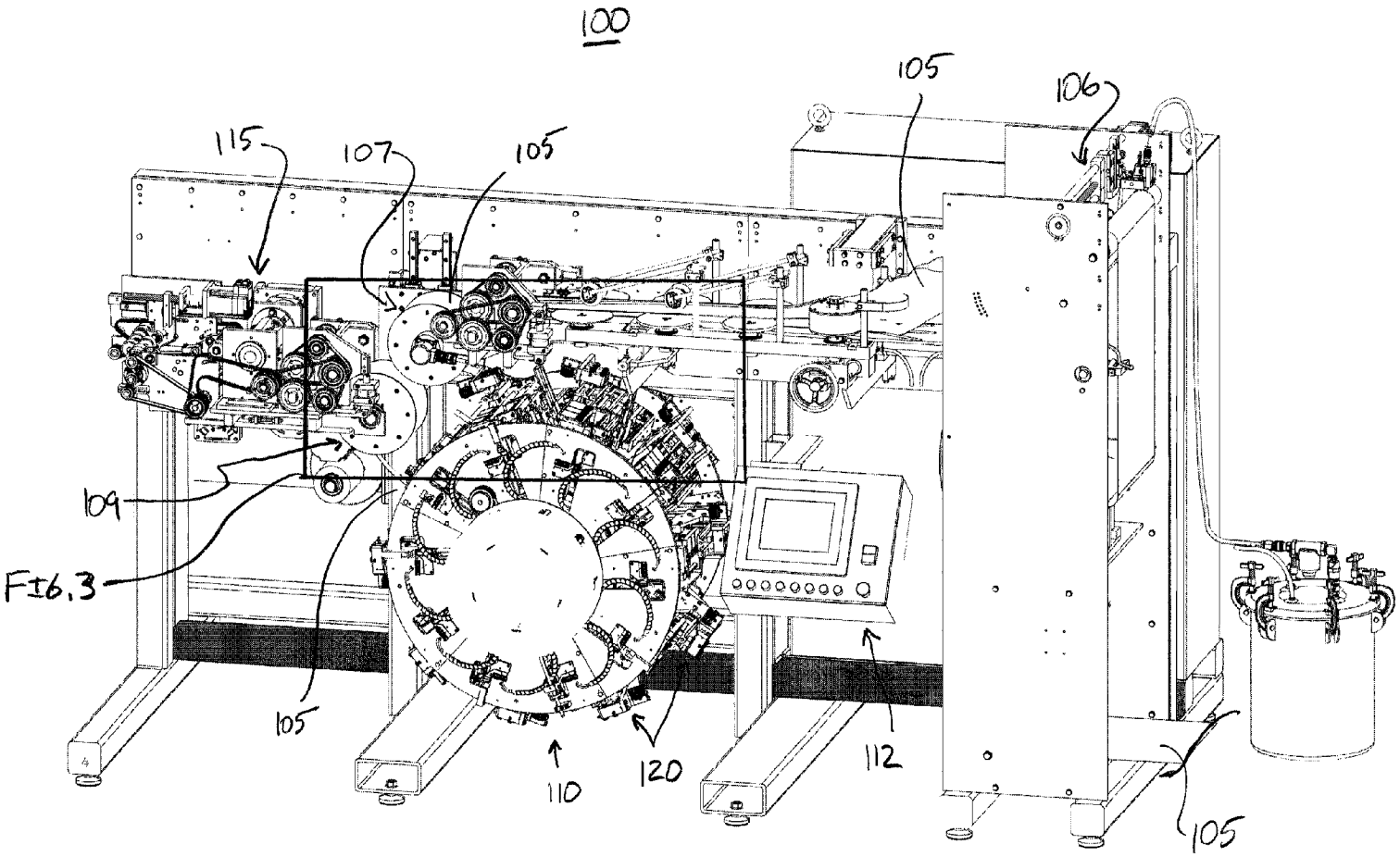
FIG. 1 shows an isometric view of an automated bag forming system according to one embodiment.
Figure 2:
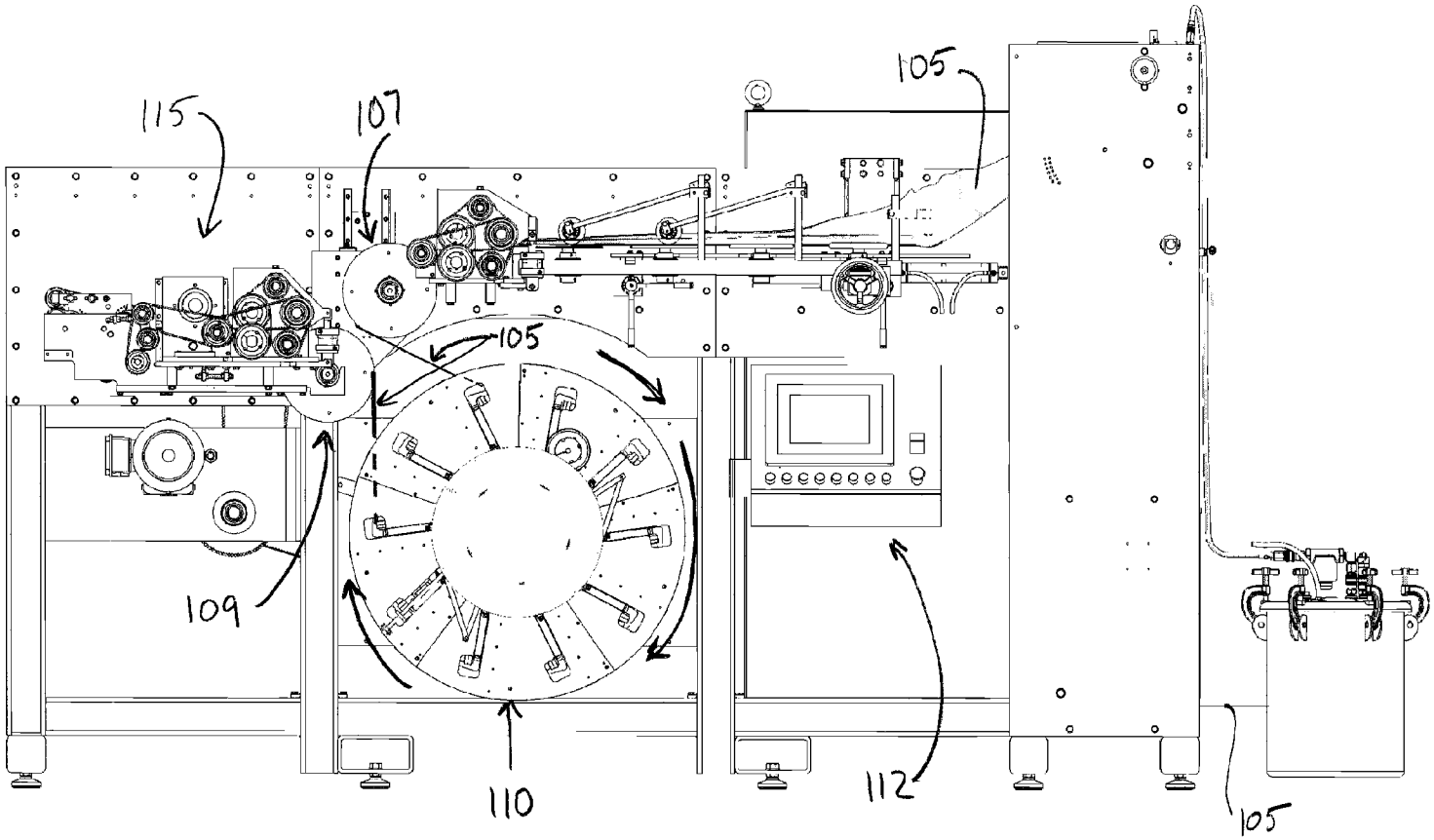
FIG. 2 shows a front elevation view of the automated bag forming system of FIG. 1.
Figure 3:
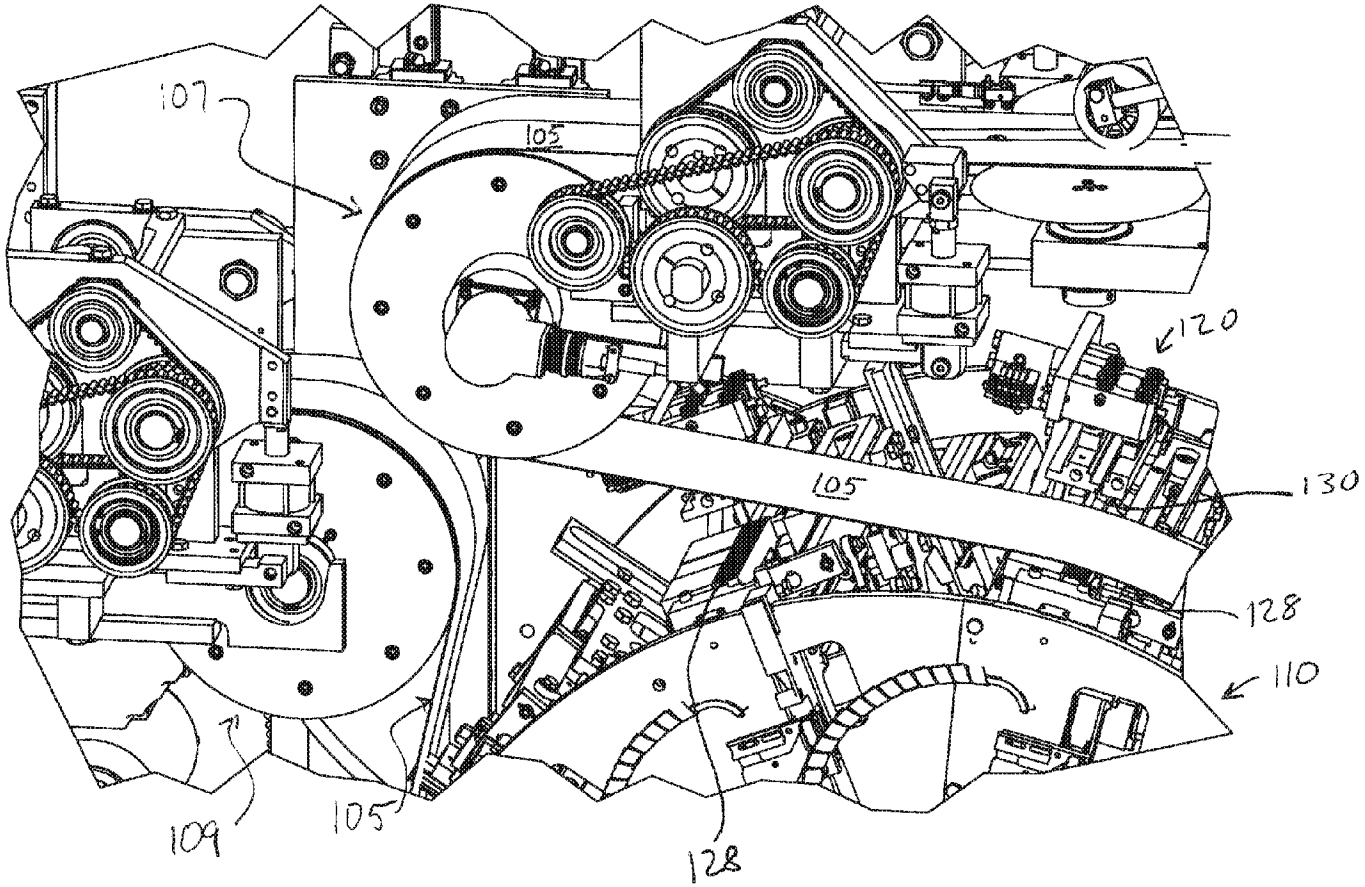
FIG. 3 shows a magnified view of components illustrated in FIG. 1.

FIGS. 1-3 illustrate one non-limiting embodiment of an automated bag-forming system (hereinafter system 100). FIGS. 1 and 2 illustrate the overall automated bag-forming system in isometric and front-elevation views, respectively; FIG. 3 shows a magnified view of the boxed section identified in FIG. 1. In this embodiment, the system 100 is configured to receive a web of bag material 105 from a web supply. Web supplies can include, for example, rolls of web material commonly sold for making individual bags. In this embodiment, a plurality of rollers 106 are configured to receive the web 105 and perform certain preparatory web functions to prepare the web 105 for processing, including, e.g., aligning the web, providing a desired amount of web tension, etc. FIG. 1 illustrates one exemplary arrangement for pre-processing the web; it will be understood that other arrangements can be used to provide the same or similar results.

Figure 5:
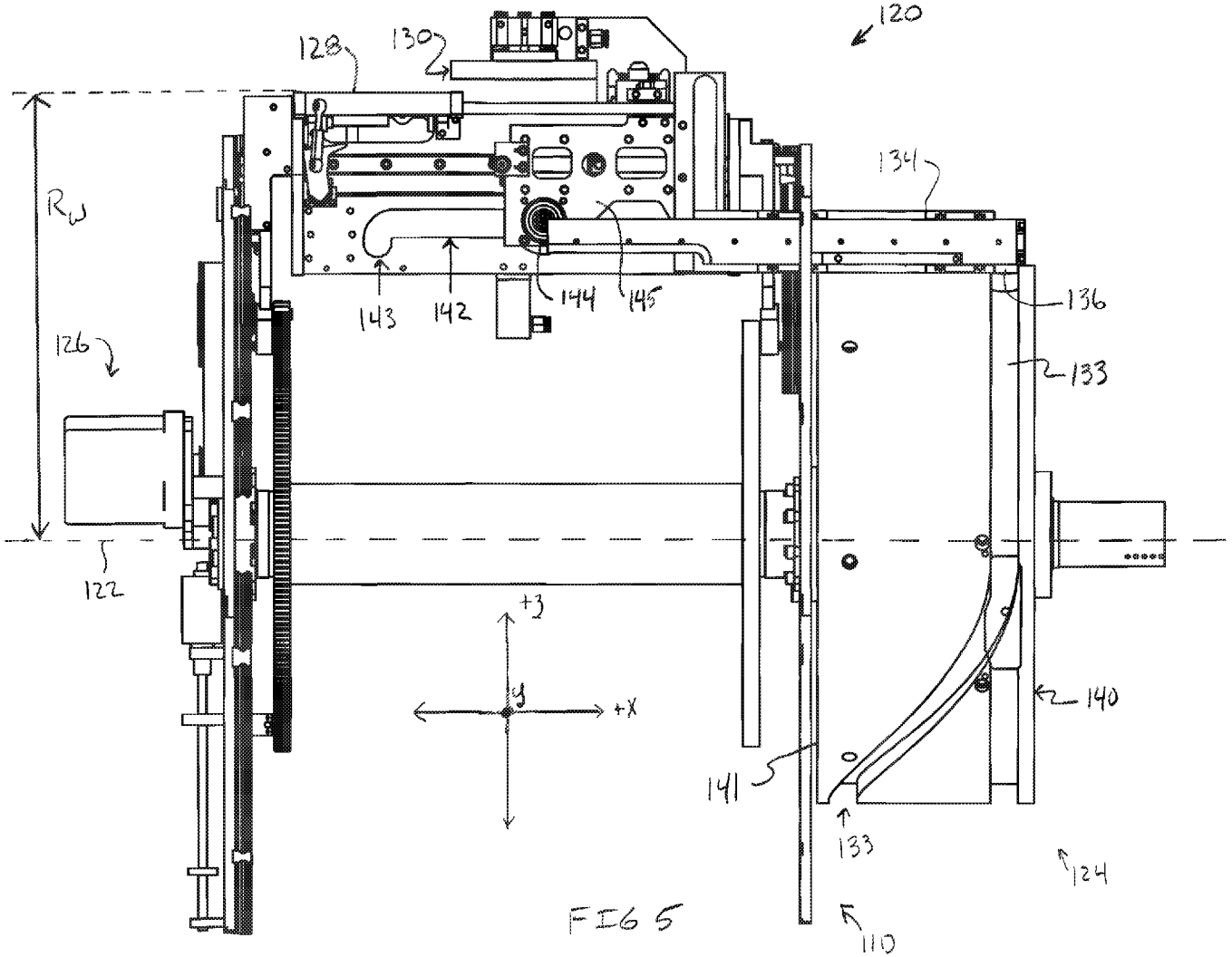
FIGS. 5-13 show front and rear elevation views of a rotatable drum assembly and an exemplary sealing assembly, to illustrate a sealing process according to one embodiment; other sealing assemblies are removed for figure clarity.

In this embodiment, the web 105 extends to a first alignment roller 107 that aligns the web feed with respect to a rotatable drum assembly (hereinafter 'rotatable drum') 110. In this embodiment, the rotatable drum 110 includes a plurality of circumferentially-disposed sealing assemblies, e.g., sealing assembly 120, which is described in greater detail herein. In this embodiment, during operation, the web 105 is conveyed onto the rotatable drum 110 where it is picked up by a sealing surface 128 of one of the plurality of sealing assemblies 120. In this embodiment, each of the plurality of sealing assemblies 120 is capable of variable-pitch adjustments, e.g., they are configured to be controllably shifted outwardly or inwardly along a radial axis (the z-axis in FIG. 5) that extends from the rotatable drum axis (labeled reference numeral 122 (FIG. 5) toward the outer circumference of the rotatable drum 110. As described in herein, such functionality provides the capability of increasing or decreasing the diameter of the rotatable drum 110 and, correspondingly, controlling the exact placement of web seals. In addition, such control allows adjustment of spacing between sealing assemblies to accommodate the production of different sized bags.

In this embodiment, after the web 105 traverses around the drum assembly 110, a second alignment roller 109 receives the web 105 and aligns it relative to a cutting assembly 115. The cutting assembly 115 is configured to cut the web at or near the location of the seal provided by one of the plurality of seal bars to produce individual bags. Any type of cutting assembly can be used; in this embodiment, an exemplary cutting assembly includes a rotary cutter. An off-loading system can remove the individual bags from the cutting assembly area when complete and perform sorting or storing functions as is generally known in the art.

Referring now to FIGS. 5-13, the rotatable drum 110 and sealing assemblies are discussed and illustrated in greater detail. In this embodiment, the rotatable drum 110 includes an axle 125 about which the drum rotates (axle 125 defines the rotational drum axis 122 illustrated in FIG. 5). In this embodiment, rotation of the drum is driven by a motor and pulley system 126; however, other systems and methods can be used to accomplish rotation of the drum. In this embodiment, the rotatable drum 110 includes a plurality of sealing assemblies, e.g., sealing assembly 120, circumferentially disposed about its periphery as illustrated. In this embodiment, each sealing assembly 120 is similarly configured, and can be configured to provide a seal to the web in a chosen location, for example, through the application of heat and pressure. For simplicity, throughout this description reference is made to sealing assembly 120 with the intent of describing each of the sealing assemblies disposed about the periphery of the drum.

In this embodiment, during an automated bag-forming process, the web is on-loaded from the first alignment roller 107 onto a sealing surface 128 of a sealing assembly 120 as the drum rotates 110, e.g., clockwise as viewed from the perspective illustrated in FIG. 2. Each sealing assembly includes a translatable seal bar 130 configured to translate over the sealing surface 128, then shift toward the sealing surface 128 to confront the web and thereby form a web seal by applied heat, pressure, or both. The process is then reversed after a seal is made so that the web can be off-loaded to the second alignment roller 109. During the shift of the seal bar 130 toward the sealing surface 128, a planar-parallel relationship is maintained therebetween. Controlled movement of the seal bar 130 relative to the sealing surface 128 is now described in greater detail.

In this embodiment, a stationary cylinder cam 124 includes a cam groove 133 that extends circumferentially about the periphery of the cylinder cam 124. The cam groove 133 is formed as a continuous loop around the cylinder cam 124 where the proximity of the groove 133 to the front surface 140 and rear surface 141 of the drum follows a substantially sinusoidal pattern. In this embodiment, the cam groove 133 provides the drive through which the seal bar 130 operates to perform sealing functionality as described in greater detail herein.

Figure 4:
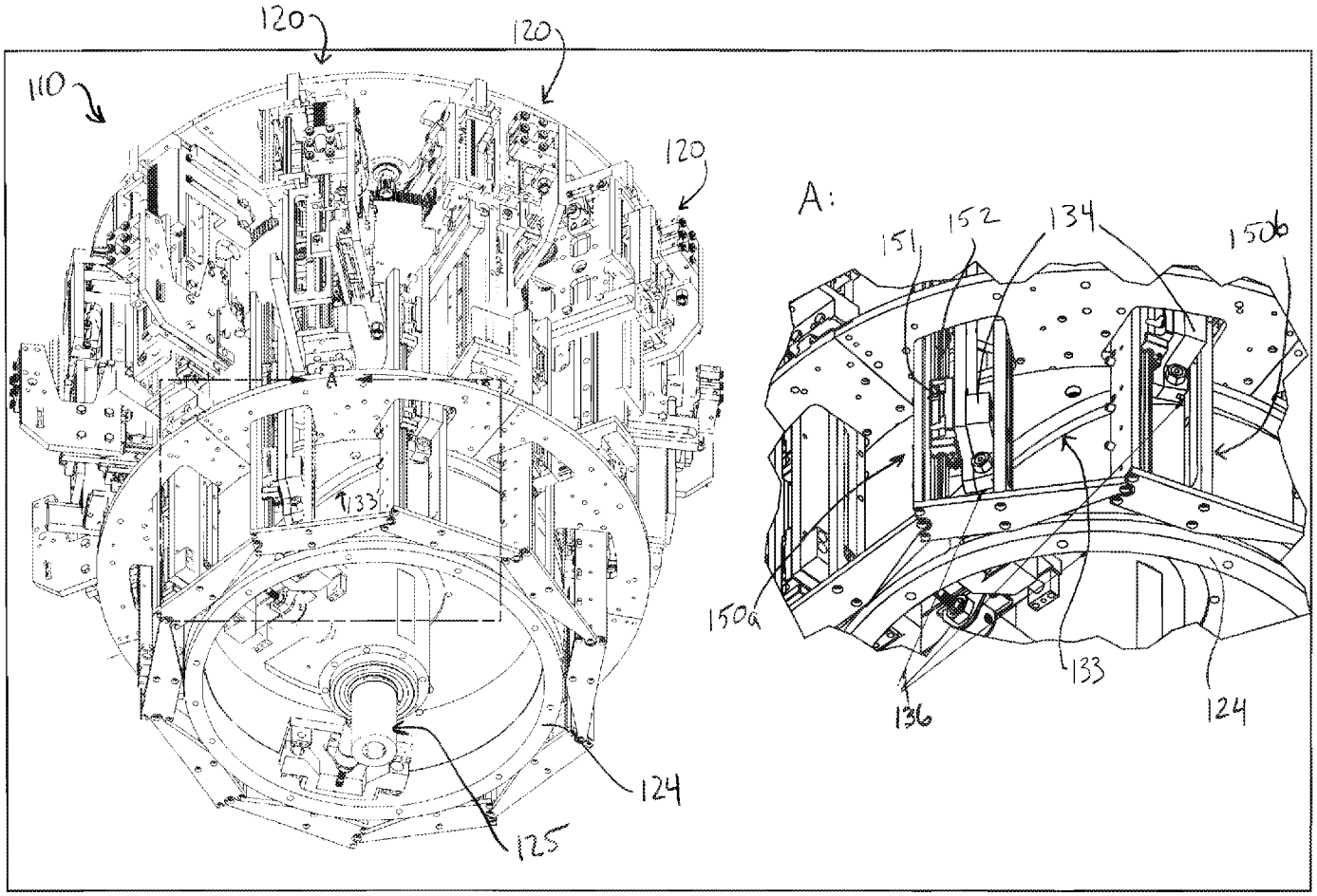
FIG. 4 shows an isometric view of a rotatable drum assembly axially aligned with a stationary cylinder cam according to one embodiment; the right side of FIG. 4 shows a magnified view of the area "A" from the left side.

Referring in particular to FIG. 4, in this embodiment, each sealing assembly 120 is coupled to a drive carriage 150 (to include 150*a* and 150*b*) that extends over the cylinder cam 124. The drive carriage 150 houses a drive bar 134, which is connected to a rail 152 by a slidable coupler 151. The drive bar 134 is coupled to a carriage assembly 145 (FIG. 5) which, in turn, is coupled to the seal bar 130. Each drive carriage 150 is pivotally coupled to its neighbor so that the plurality of carriages is able to traverse the circumference of the cam cylinder 124. The drive carriage 150 is configured and oriented to allow the cam follower 136 to remain in the cam groove 133 as the carriage 150 rotates around the cam cylinder 124. Referring to drive carriages 150*a* and 150*b* in the magnified view (right side) of FIG. 4, the translation of the drive bar 134 is illustrated in each case as it slides along rail 152, which is caused by cam follower 136 following the cam groove 133 in the cam cylinder 124.

Figure 6:
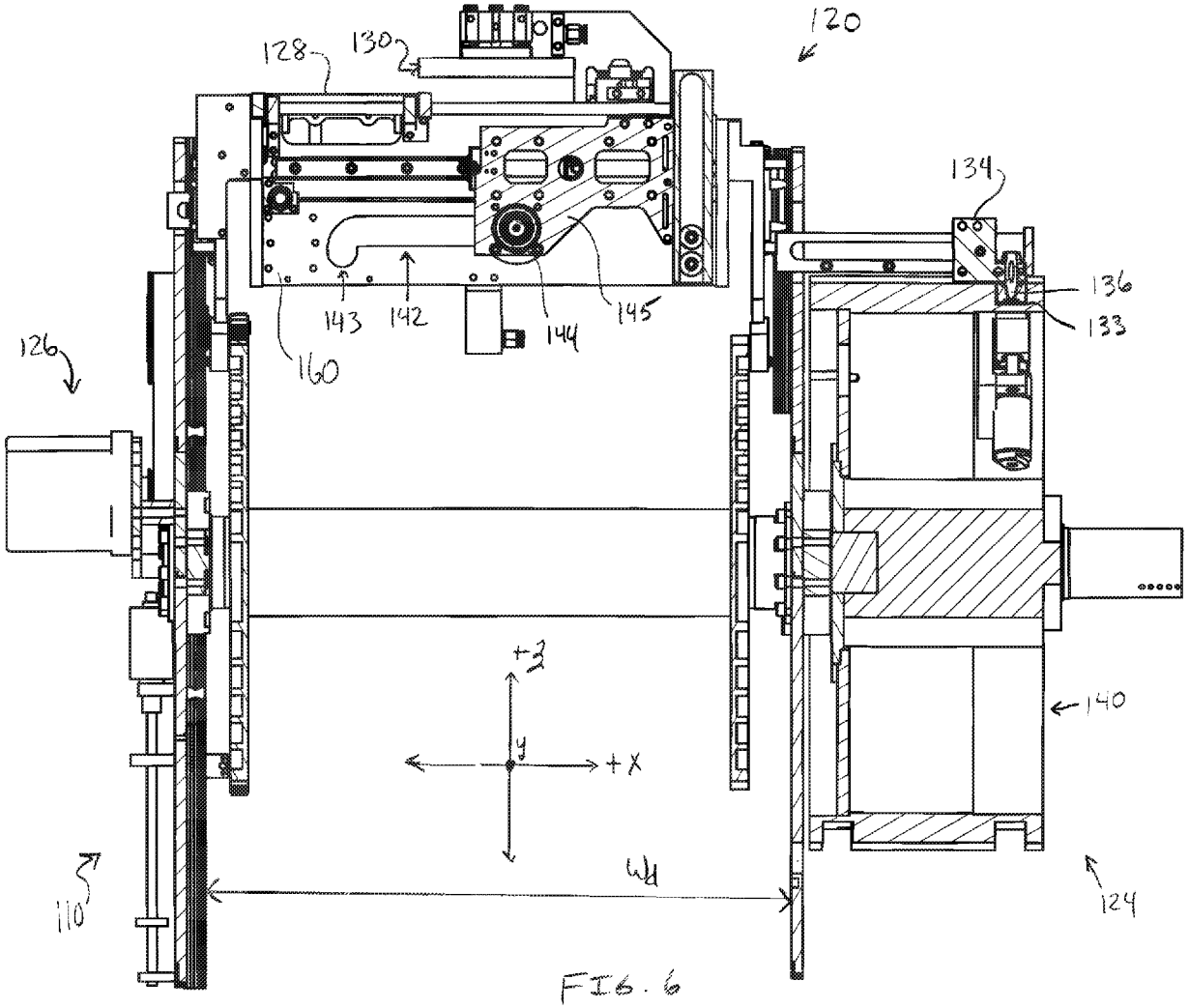
Figure 7:
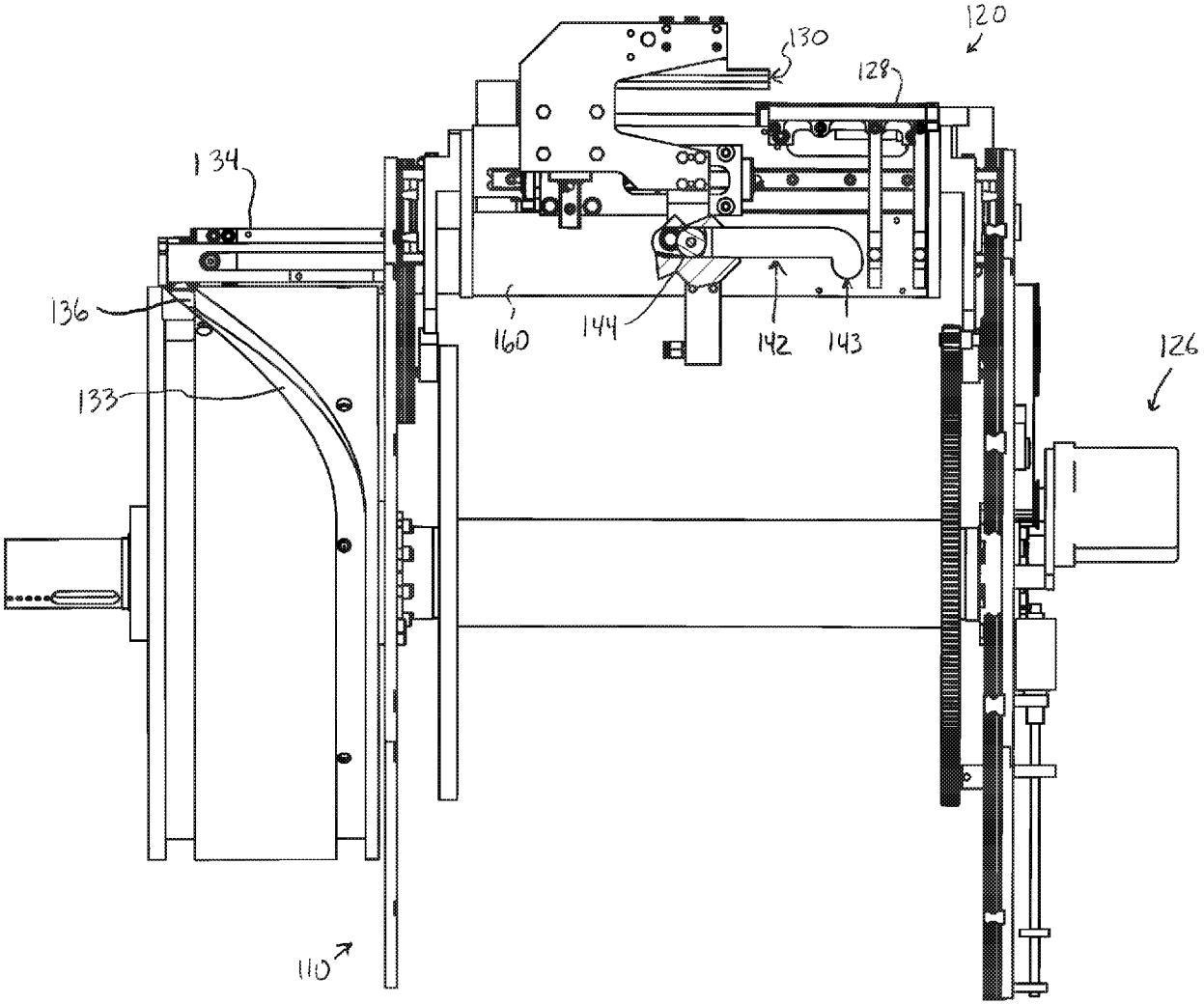

Referring to FIGS. 6-13, movement of the carriage assembly 145 is shown in a sequential order to illustrate sealing action of the sealing assembly 120. FIGS. 6-7 illustrate the sealing assembly 120 in front and rear elevation views, respectively, where the seal bar 130 is in a first, open configuration, maximally displaced from the sealing surface 128 in the x and z dimensions. In this configuration, the cam follower 136 of the drive bar 134 is correspondingly positioned near the front surface of the cylinder cam 124 by virtue of the position of the cam groove 133 in which it follows. This first position can be the configuration used when on-loading the web from the first alignment roller 107, to avoid interference from the seal bar 130.

In this embodiment, shifting of the drive bar 134 causes synchronous shifting of the carriage assembly 145 along an L-shaped slot 142 in a support beam 160 which spans the width $w_d$ of the rotatable drum 110 (see, e.g., FIG. 6). In this embodiment, the support beam 160 provides a support base for the sealing area 128 and the carriage assembly 145, among other structures of the sealing assembly. The carriage assembly 145 is directly coupled to the seal bar 130 so that translation of the carriage assembly 145 engenders synchronous movement of the seal bar 130. In this embodiment, the carriage assembly 145 is coupled to an axle 144 that allows it to shift along the L-shaped slot 142 with minimum resistance. When performing a seal, the carriage assembly 145 translates horizontally (along the x-axis in FIG. 5) until it reaches the base of the "L" 143, where it then shifts vertically (in the −z direction), causing the seal bar 130 to bear down on the sealing surface 128 as illustrated next.

Figure 8:
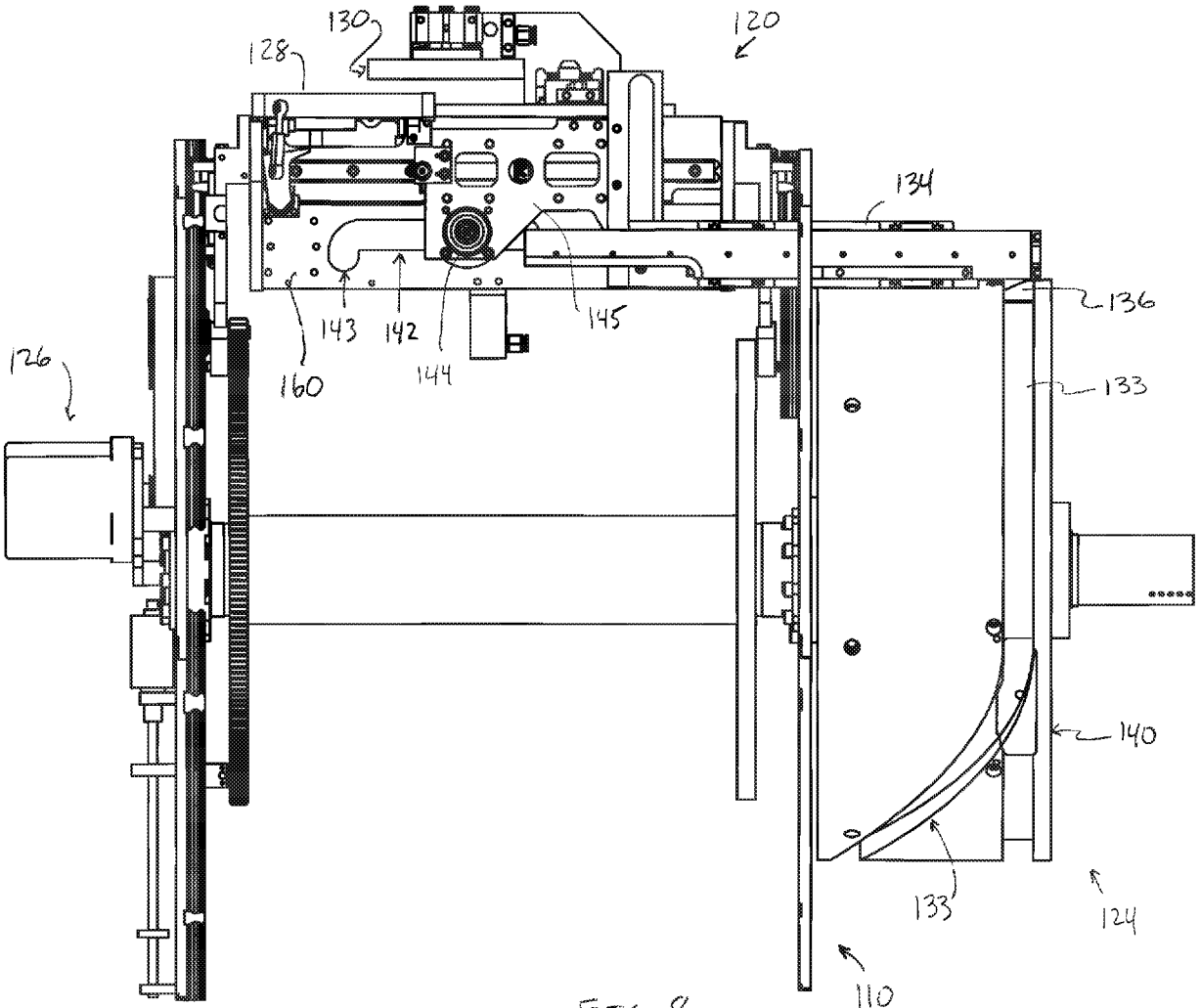
Figure 9:
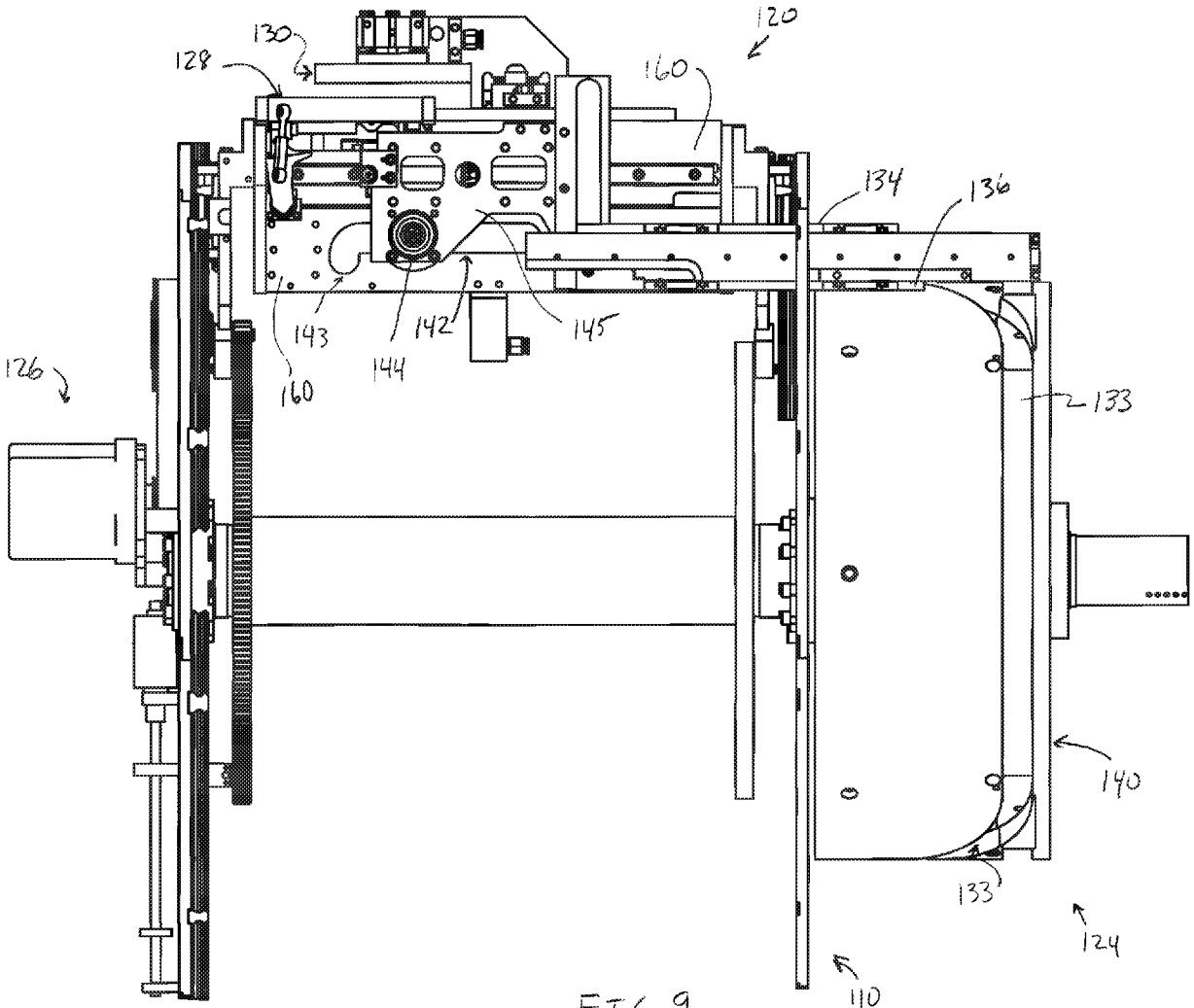

Continuing with the sequence, referring next to FIGS. 8 and 9, the carriage assembly 145 is shown progressively shifting along the L-shaped slot 142, toward the sealing surface 128. In this embodiment, this shifting results from the rotation of the drive carriage 150 around the cylinder cam 124, which has caused the cam follower 136 and, correspondingly, the drive bar 134 to shift according to the configuration of the cam groove 133, as described herein.

Figure 10:
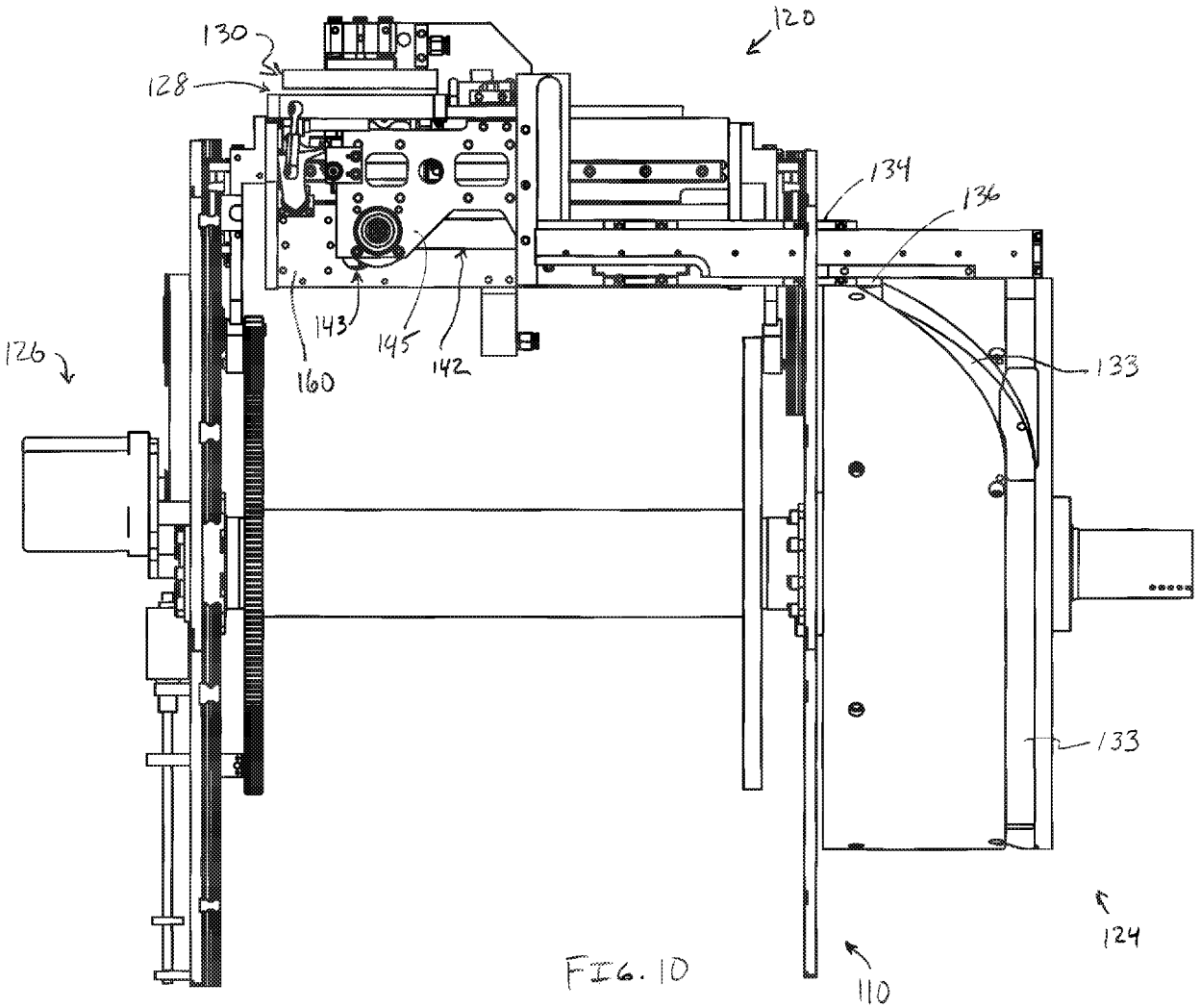
Figure 11:
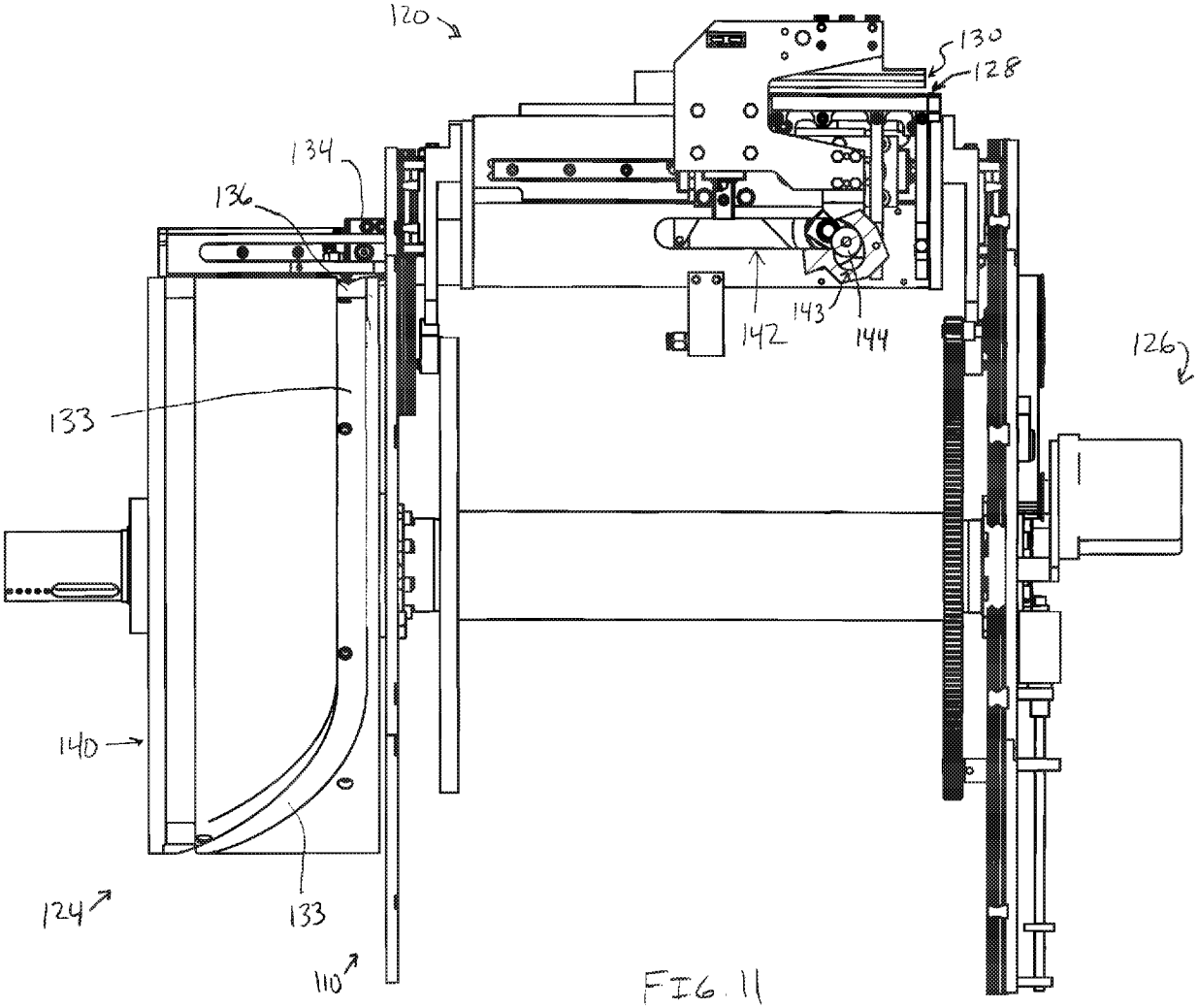
Figure 12:
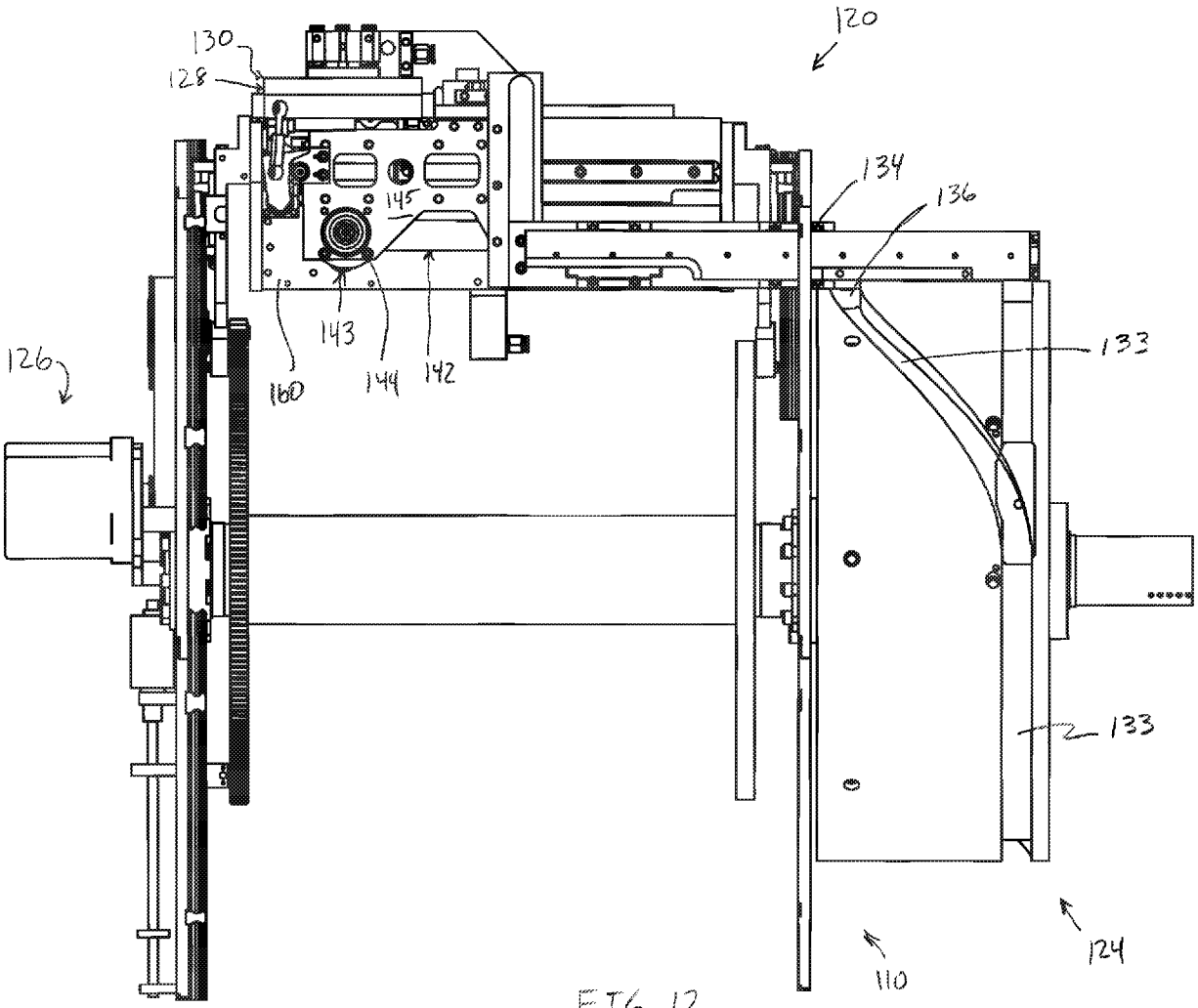
Figure 13:
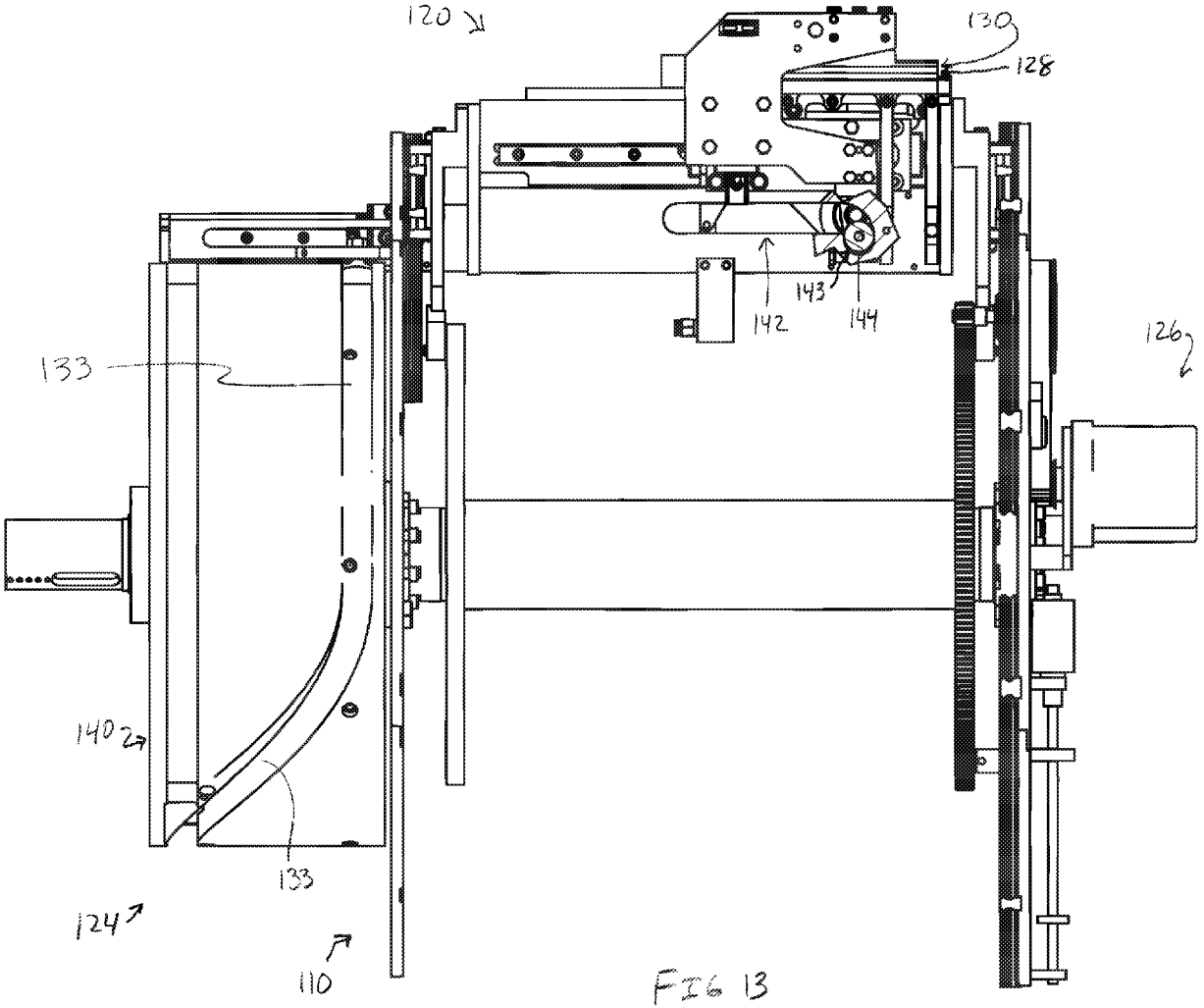

FIGS. 8 and 9 illustrate the carriage assembly 145 and, correspondingly, the seal bar 130 progressively shifting in the direction of the sealing surface 128 until, as illustrated in FIGS. 10 and 11, the seal bar 130 and the sealing surface 128 are aligned in a parallel-planar orientation, substantially opposite to each other. Referring now to FIGS. 12 and 13, when the axle 144 of the carriage assembly 145 reaches the threshold of the base of the L-shaped slot 143, the carriage assembly 145 and, correspondingly, the seal bar 130 are shifted in a downward (−z) direction such that the seal bar 130 and the sealing surface 128 are brought to a substantially confronting relationship. In doing so, when a web is present therebetween, a seal is formed in the web through the application of heat, pressure, or a combination thereof.

It should be understood that the seal bar 130 or the sealing surface 128, or both, can be configured to accommodate sealing of any type of bag, and the description herein is not limited to bag forming processes where the web material is sealed by heat and/or pressure. In this and other embodiments, the amount of heat applied to the web can be controlled by varying the temperature of the sealing surface 128, the seal bar 130, or both. Furthermore, the length of time the seal bar 130 remains in a substantially confronting relationship to the sealing surface 128 can be controlled, e.g., by controlling the angular velocity of the rotating drum 110 or other parameters.

After a seal has been made in the web, the movement of the carriage assembly 145 will reverse course as groove 133 begins to lead the cam follower away from the sealing area. In this embodiment, the carriage assembly will first shift up, in the +z direction, then shift in a direction toward the front surface 140 of the cam cylinder 124 to return to the open configuration. In one embodiment, a mechanical disengaging force can be automatically applied to the carriage assembly 145 to urge the axle 144 from the base 143 of the L-shaped slot 142, e.g., through use of a piston or similar member when the carriage is to be reversed. In such an embodiment, the piston can be configured and timed to apply the disengaging force, e.g., when the cam follower 136 begins to move in the +x direction as depicted in, e.g., FIG. 5. In one embodiment, the configuration of the L-shaped slot 142, the depth of the base of the "L" 143, and the diameter of the carriage assembly axle 144 can be selected so that continuous motion of the cam follower 136 along the cam groove 133 is sufficient to reset the carriage assembly—and thus the seal bar 130—to its original position, e.g., the position illustrated in FIG. 5. In this embodiment, after the seal bar 130 has shifted away from the sealing surface 128, the web can be off-loaded onto the second alignment roller 109 where it can subsequently be cut by the cutting assembly into individual bags.

Figure 14:
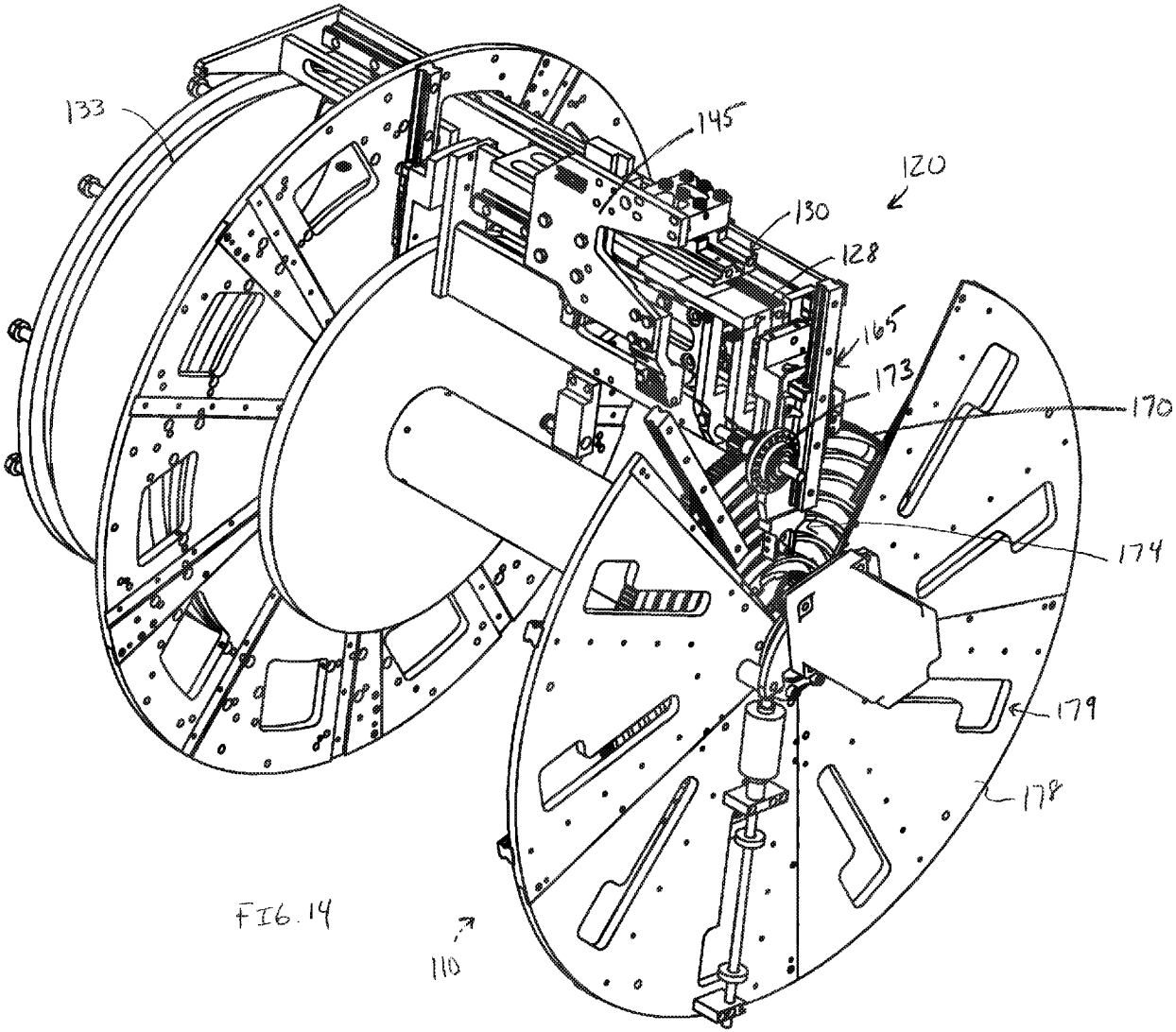
FIG. 14 illustrates a sealing assembly coupled to a rotatable spiral cam, according to one embodiment.
Figure 15:
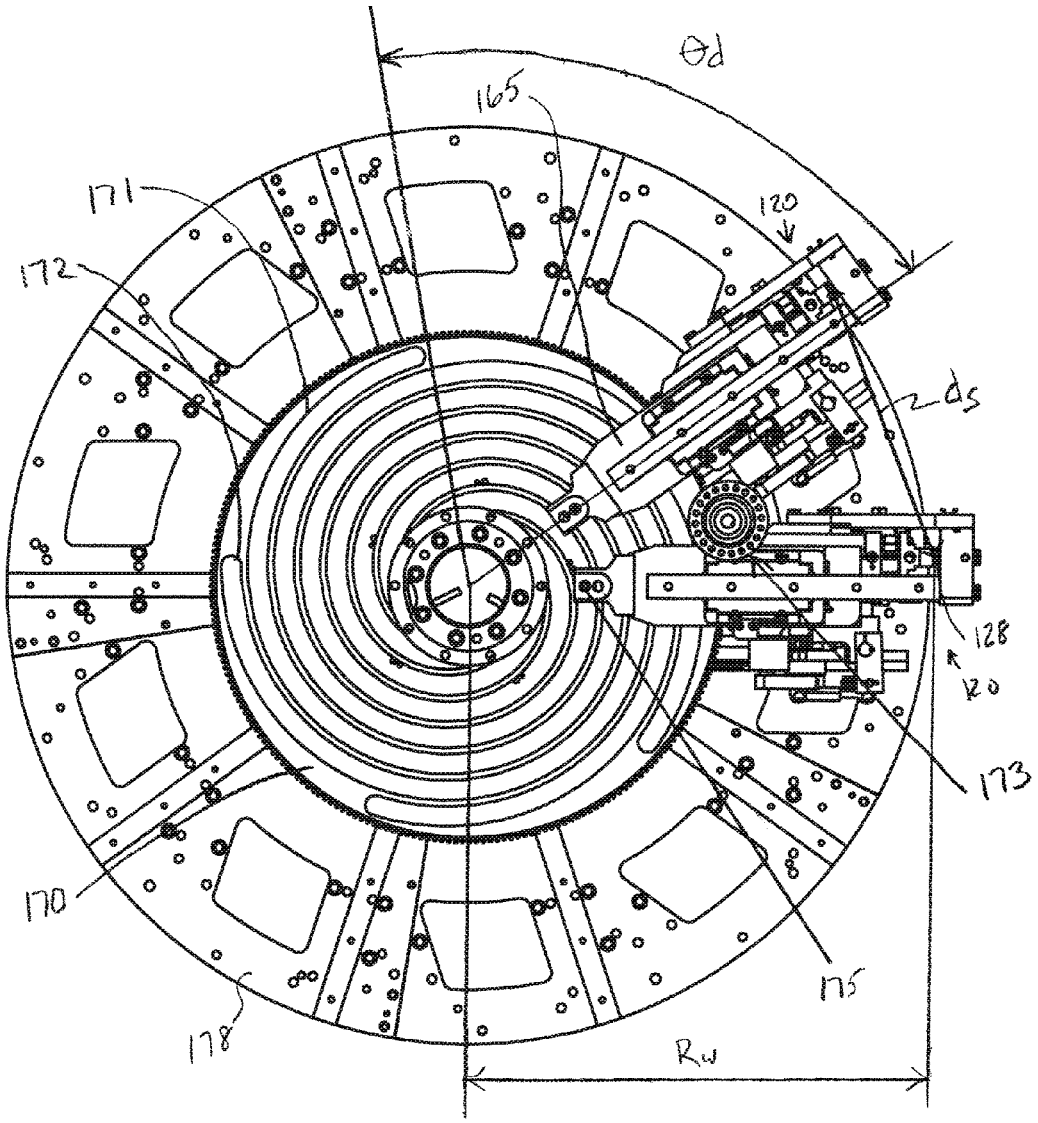
FIG. 15 shows a front elevation view of two veins coupled to a spiral cam, according to one embodiment.

Referring now to FIGS. 14-17, in this embodiment, the working diameter of the rotatable drum 110, e.g., $2R_w$ (FIG. 15) can be increased or decreased during operation to control the exact placement of web seals by the sealing assemblies. Such variable-pitch functionality can be used to accommodate the production of various bag sizes and to correct for seal placement 'trending,' i.e., placement of seals during bag production that are off-target with respect to, e.g., product printing that may be on the web or other factors, which can consequently lead to faulty bag products. FIGS. 14 and 15 illustrate that, in this embodiment, each sealing assembly 120 is coupled to a radially-translatable frame member 165. In the description that follows, the combination of a sealing assembly 120 and a frame member 165 is referred to as a 'vein' for simplicity.

In this embodiment, each frame member 165 includes a cam follower 175 at a distal end 174, which, in this embodiment, is an end closest to the rotatable drum axis 122. A disk-shaped cam 170 (herein after referred to as a 'spiral cam' 170) includes a plurality of spiral-shaped slots, e.g., slots 171, 172 which originate near the central axis of the spiral cam 170 and extend spirally outward as illustrated, and are configured to receive the cam follower 175 of the frame member 165. In this embodiment, the spiral cam 170 includes five spiral slots, wherein each slot accommodates two veins, e.g., slot 1 accommodates veins 1 and 2; slot 2 accommodates veins 3 and 4; and so on. The spiral cam 170 is configured to rotate axially, in either direction, e.g., clockwise or counter-clockwise as viewed in the front elevation view of FIG. 15, and is rotationally independent of the rotation of the drum 110.

In this embodiment, a stepper motor 173 is configured to rotate a gear shaft engaged with complimentary gear teeth disposed about the outer circumference of the spiral cam 170. The stepper motor 173 is configured to rotate the spiral cam 170 in clockwise or counterclockwise directions according to signals received by a computer control system 112 described in greater detail herein.

In this embodiment, rotation of the spiral cam 170 causes the veins to translate along a radial path inwardly (toward the drum axis 122) or outwardly (away from the drum axis 122) depending on the rotation direction of the spiral cam 170. For example, in FIG. 15, counter-clockwise rotation of spiral cam 170 will cause the veins to translate outwardly, increasing the working diameter of the rotatable drum 110, while clockwise rotation will cause the veins to translate inwardly, decreasing the working diameter of the drum 110. Similarly, the distance between adjacent sealing surfaces ($d_s$ in FIG. 15) increases (decreases) as the veins shift outwardly (inwardly).

Seal placement trending is a phenomenon where the placement of bag seals "drifts" away from its intended target on the web. In this embodiment, trending is corrected during operation of the system 100 in a computer-controlled, automated feedback loop by monitoring for the presence (detection) of a registration mark on the web at a known location on the system 100, and substantially synchronously measuring a vein angle $\theta_d$ in a process described in greater detail below.

In this embodiment, registration marks are detected by an optical detection system (not illustrated) disposed near the plurality of rollers 106 as the web enters the system 100. While optical detection is preferred for the detection of registration marks, other systems can be used to provide the same or similar functionality. One non-limiting optical detection system is sold by Sick AG, Waldkirch, Germany (part no. KT5W-2P1116D).

In this embodiment, the vein angle $\theta_d$ is an angle between the vertical axis and the vein as illustrated in FIG. 15. It should be understood that the vertical axis shown in FIG. 15 is chosen arbitrarily for convenience and that any reference axis can be used in a real-world system. In this embodiment, the angle $\theta_d$ is measured using an encoder assembly coupled to the rotatable drum 110.

In this embodiment, the optical detection system, and the encoder assembly are configured to send detection and angle measurements, respectively, to the control system 112 which is configured to receive and process such signals. The control system is also in signal communication with the stepper motor 173 for the purpose of controlling rotation of the spiral cam 170. In this embodiment, the control system 112 is an Allen-Bradley® programmable logic controller (Rockwell Automation, Milwaukee Wis.).

In this embodiment, seal placement trending is controlled using a PID process that monitors the detection of a web registration mark on the system 100 and simultaneously captures the vein angle $\theta_d$ from the encoder. The control system 112 determines a difference value between the measured vein angle $\theta_d$ and an "optimal" angle $\theta_{OPT}$ which represents a vein angle that places a web seal exactly on a target location. In general, the optimal vein angle $\theta_{OPT}$ can be known or determined. During operation, if the difference value falls outside of a predetermined value range, e.g., +/−0.003", then the system can send a control signal to the stepper motor to cause 173 rotation of the spiral cam 170 in a direction that corrects for the angle offset, e.g., by moving the spiral cam 170 clockwise or counterclockwise to minimize the difference value determined during the following iteration. The control system 112 can continually monitor the determined difference value and make adjustments accordingly. In one embodiment, the control system can be programmed to evaluate the difference value as often as necessary to achieve desired precision in the location of applied web seals.

Figure 16:
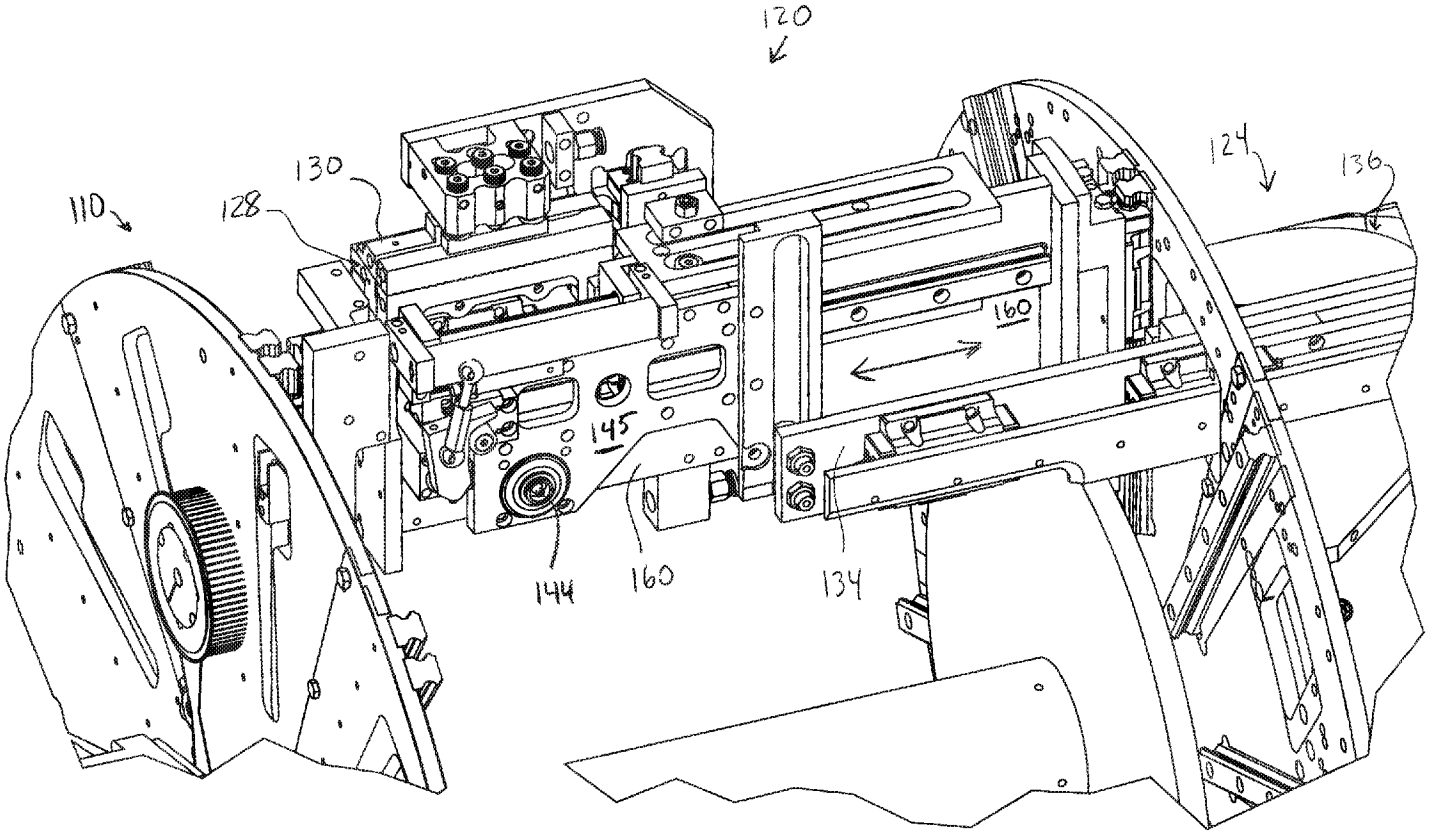
FIGS. 16 and 17 illustrate radial movement of an exemplary sealing assembly according to one embodiment.
Figure 17:
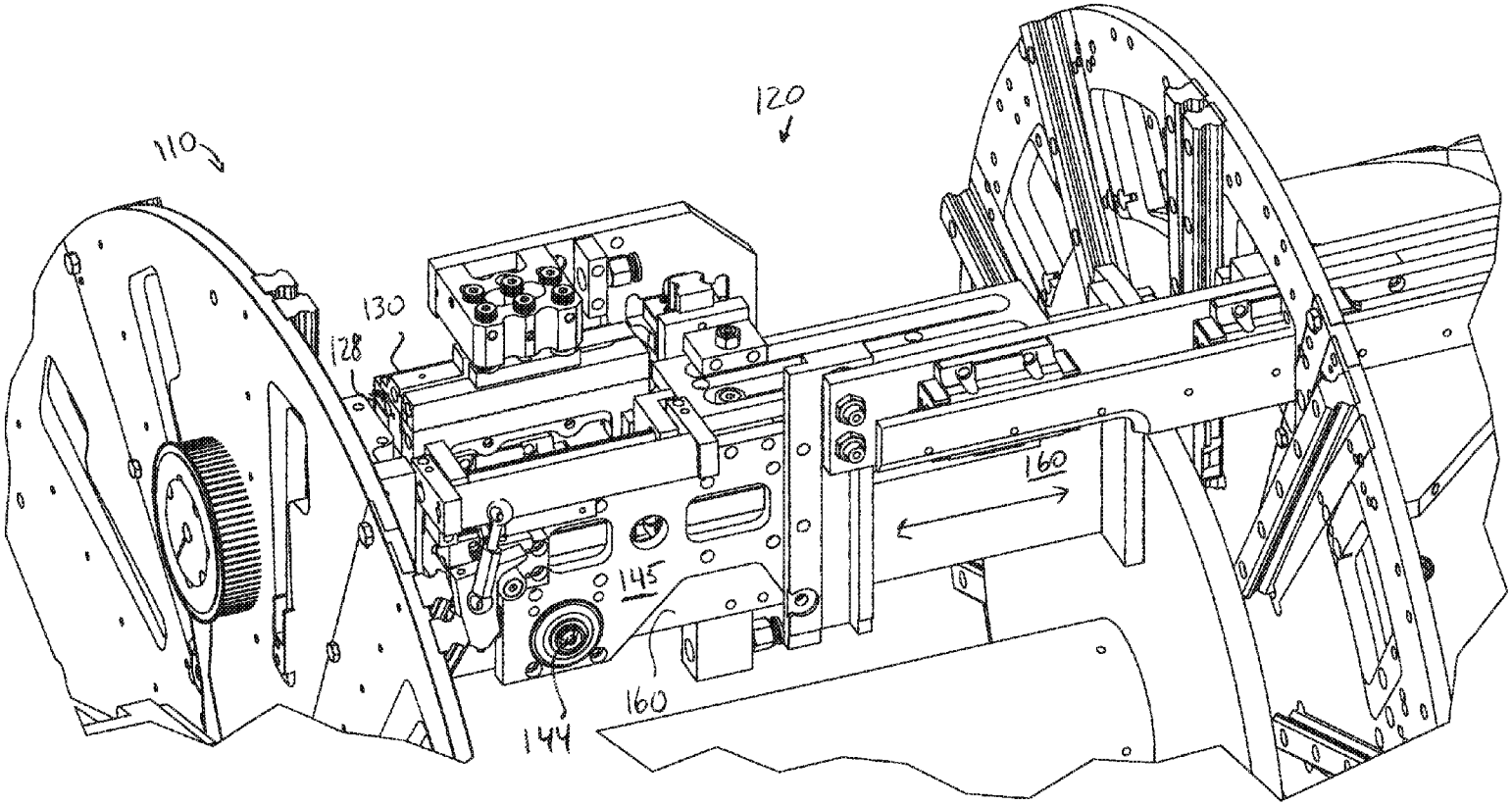

FIGS. 16 and 17 illustrate radial translation of a sealing assembly 120. FIG. 16 illustrates the sealing assembly 120 in a fully retracted configuration where it is shifted toward the drum axis 122, while FIG. 17 illustrates the sealing assembly 120 in a fully outwardly-expanded configuration.

Figure 18:
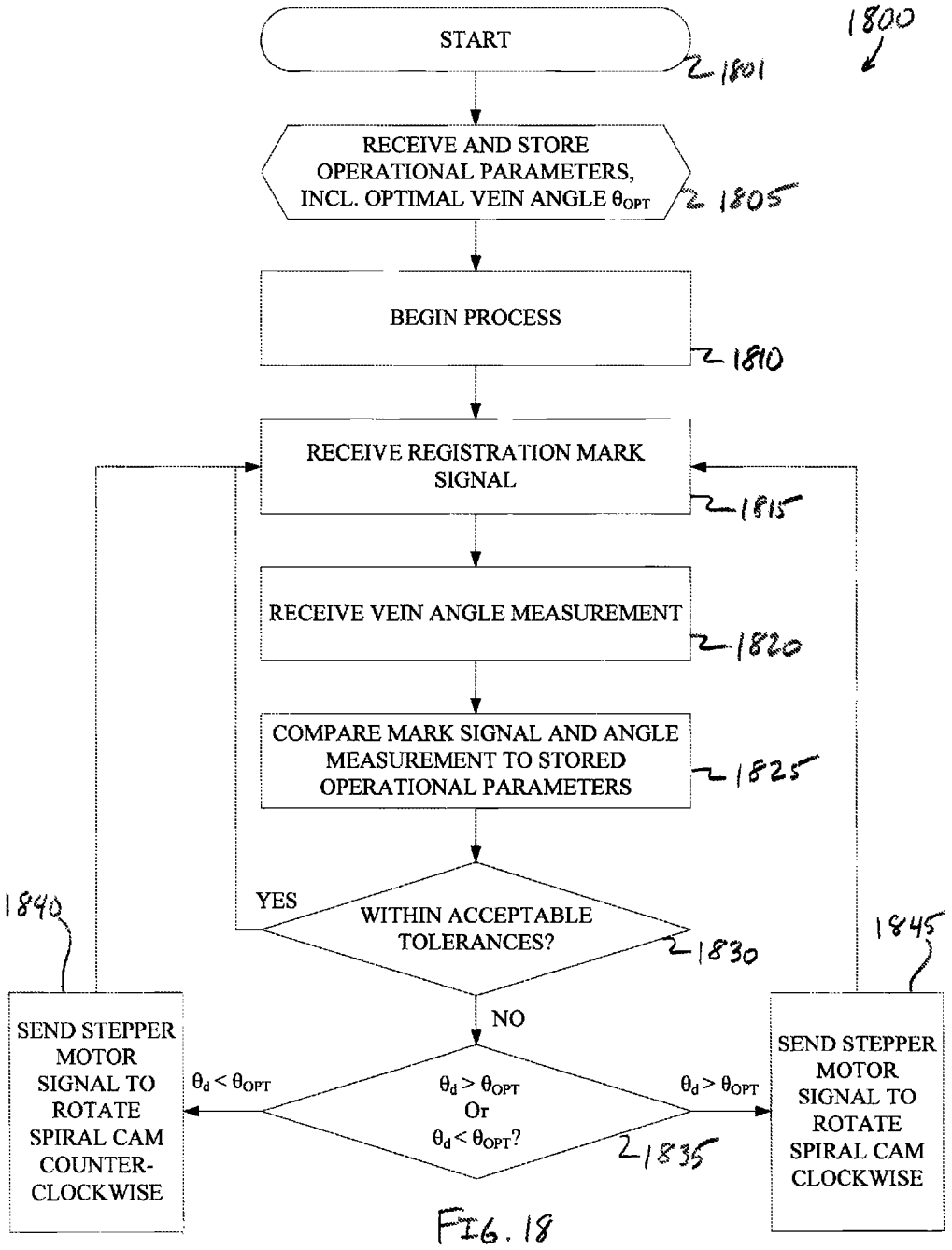
FIG. 18 shows a process flow diagram for controlling seal placement trending, according to one embodiment.

Referring now to FIG. 18, a flowchart of a computer-implemented process 1800 is shown that illustrates operation of the system 100 according to one, non-limiting embodiment. The computer implemented steps in the flowchart can be carried out by the computer control system 112 and is so described herein. It should be understood that, while the foregoing description is suitable for the present embodiment, other feedback control methods can be substituted according to various factors such as cost, efficiency, speed, and other factors.

Beginning at step 1801, the computer control system is initialized, which can include, inter alia, steps to boot the computer, loading software packages or platforms for running the forthcoming process 1800 steps, loading drivers, and initializing peripheral items such as the optical detection system, and the drum angle encoder.

Next, at step 1805, the control system 112 can receive operational parameters as input, relating to the operation of the system 100; among those parameters can be the optimal vein angle variable, $\theta_{OPT}$. The system 112 can receive other control inputs, such as a duration time that the system 100 should run, drum speed, precision tolerances, and other inputs. In this embodiment, the inputs can be stored, e.g., in volatile or permanent memory, e.g., RAM or on a disk drive. In one embodiment, the system 112 can be configured to store a plurality of parameters corresponding to different web types so that a user can select from one or more stored profiles to load the appropriate operational parameters efficiently.

Next, at step 1810, the system 100 can be activated to begin producing bags. During this step, the system 112 can cause, e.g., rotation of the drum 110, activation of roller assemblies, e.g., rollers 106, 107, 109, etc. concurrently with the processes of steps 1815 and 1820, described next.

At step 1815, the system 112 waits for a signal from the optical detection system that a registration mark has been detected. Upon receiving such a signal, the process moves to step 1820 where the system 112 reads the drum angle encoder to determine $\theta_d$.

Next, at step 1825, the system 112 compares the received angle measurement $\theta_d$ with the stored optimal angle $\theta_{OPT}$ that was input (or loaded) during step 1805 to determine a difference value. At decision point 1830, the system 112 determines whether the difference value is within an acceptable tolerance range. The acceptable tolerance range can be, e.g., a value set by the system operator that reflects an acceptable limit in the variation of the measured angle $\theta_d$ compared to the optimized angle $\theta_{OPT}$. For example, a tolerance range of +/−0.5 degrees can be set by the system operator such that a measurement of $8.5° < \theta_d < 9.5°$ would be considered within acceptable limits for an optimal angle $\theta_{OPT}$ of 9.0 degrees.

At step 1830, if the difference value is within acceptable tolerance limits, the process loops back to step 1815. If, however, the difference value is outside of the acceptable tolerance limits, the process moves to step 1835, where the system 112 determines if the measured vein angle was greater than, or less than the optimal angle. Keeping with the illustration shown in FIG. 15, if $\theta_d > \theta_{OPT}$, the system 112 sends a control signal to the stepper motor 173 to cause the spiral spiral cam 170 to rotate counter-clockwise, step 1845, thus retracting the veins and 'shrinking' the working diameter of the drum 110. The process then loops back to step 1815. If, on the other hand, $\theta_d < \theta_{OPT}$, the system 112 sends a control signal to the stepper motor 173 to rotate the spiral cam counter-clockwise, step 1840, thus shifting the veins outward and increasing the working diameter of the drum 110; the process then loops back to step 1815. The process 1800 can continue until, e.g., a user shuts the system down (not illustrated in process 1800).

The foregoing process allows the system 100 to fine-tune the placement of seals on a web. In this and other embodiments, bags of various sizes can be formed through the process of expanding or contracting the working diameter of the drum 110 as described herein. In some embodiments, a greater or lesser number of sealing assemblies 120 can be utilized to coarsely adjust the spacings therebetween, and thereby form taller or shorter bags as the case may be.

In some cases, formation of very small bags may be impeded by the dimensions of the veins, sealing assemblies, or both. In other words, the size of, e.g., the sealing assembly may space the sealing surfaces around the drum at a distance that is greater than the desired bag size. To address this, in an alternative embodiment, an automated bag forming system can include a plurality of rotational drums (e.g., rotational drum 110). The first rotational drum can produce a series of seals in the web at a given interval, e.g., every 10 inches. A second rotational drum can receive the web from the first rotational drum and be configured to produce secondary seals between the seals made by the first drum to produce, e.g., 5-inch bags. This concept can be extended to automated bag forming systems having 3, 4, 5, or as many rotational drums as necessary to achieve formation of a desired bag size. In such embodiments, PID control can be applied as described above to each drum to achieve precise dimension control in the formed bag product.

In one working prototype, a system similar to the one described with respect to system 100 is capable of producing bags at a rate of about 405 per minute while maintaining precision of +/−0.0015 inches in the targeted placement of the bag seal.

A number of illustrative embodiments have been described. Nevertheless, it will be understood that various modifications may be made without departing from the spirit and scope of the various embodiments presented herein. Accordingly, other embodiments are within the scope of the following claims.

What is claimed is:

1. An automated bag forming system, comprising:

a stationary cylinder cam having a cam groove disposed about its periphery;

a first rotatable drum assembly coaxially aligned with said cylinder cam, wherein said rotatable drum assembly comprises:

a plurality of circumferentially-disposed sealing assemblies, each sealing assembly being disposed on said rotatable drum, and comprising:

a sealing surface;

a seal bar shiftable between an open configuration and a closed configuration wherein said seal bar confronts said sealing surface; and a reversibly-shiftable drive bar comprising a cam follower engaged with said cam groove; wherein rotation of said rotatable drum causes said drive bar to shift, and wherein shifting of said drive bar causes said seal bar to correspondingly shift between said open configuration and said closed configuration;

wherein each of said sealing assemblies is coupled to a variable-pitch control assembly via a radially-translatable frame member;

wherein said variable-pitch control assembly comprises a motor-driven, rotatable cam capable of rotating in clockwise or counterclockwise directions;

wherein said rotatable cam comprises a plurality of spiraled grooves, and wherein each of said radially-translatable frame members comprises a cam follower configured to engage at least one of said plurality of spiraled grooves to cause said sealing assemblies to translate along a correction pathway;

wherein a distance between a first sealing assembly and a second, adjacent sealing assembly is adjustable; and wherein said distance is adjustable by rotating said rotatable cam in a selected direction to cause said plurality of sealing assemblies to shift outwardly or inwardly along said correction pathway.

* * * * *